United States Patent [19]

Govaerts et al.

[11] Patent Number: 4,498,030

[45] Date of Patent: Feb. 5, 1985

[54] HIGH-PRESSURE SODIUM VAPOR DISCHARGE LAMP WITH BIMETALLIC ELEMENT

[75] Inventors: Karel J. Govaerts; Louis J. Dehouwer, both of Eindhoven, Netherlands

[73] Assignee: U.S. Philips Corporation, New York, N.Y.

[21] Appl. No.: 441,185

[22] Filed: Nov. 12, 1982

[30] Foreign Application Priority Data

Dec. 17, 1981 [NL] Netherlands ..... 8105687

[51] Int. Cl.[3] ..... H01J 7/44

[52] U.S. Cl. ..... 315/60; 315/47; 315/73

[58] Field of Search ..... 315/47, 56, 60, 61, 315/73

[56] References Cited

U.S. PATENT DOCUMENTS 4,277,725 7/1981 Sneijers ..... 315/73

*Primary Examiner*—David K. Moore

*Attorney, Agent, or Firm*—Robert S. Smith

[57] ABSTRACT

The invention relates to a high-pressure sodium vapor discharge lamp comprising a discharge vessel and a glow starter. The glow starter in the inoperative condition of the lamp is electrically connected parallel to the discharge vessel. In the operative condition the glow starter is switched off electrically by means of a bimetal switch. According to the invention the contact point of the bimetal switch which is connected to the glow starter is situated on the wall of the discharge vessel. Herewith a reliable and simply realizable positioning of the contact point is obtained.

1 Claim, 3 Drawing Figures

HIGH-PRESSURE SODIUM VAPOR DISCHARGE LAMP WITH BIMETALLIC ELEMENT

The invention relates to a high-pressure sodium vapor discharge lamp having a discharge vessel comprising a ceramic wall and a first and a second main electrode between which the discharge path extends, said lamp also comprising a glow starter a terminal of which is connected to a contact point of a bimetal switch, said glow starter, in inoperative condition of the lamp, being connected electrically parallel to the discharge path by means of the bimetal switch and, in operative condition of the lamp, being switched off electrically by means of the bimetal switch. In this connection, ceramic wall is to be understood to mean a wall consisting of a crystalline oxide which is resistant to sodium, for example monocrystalline sapphire or polycrystalline densely-sintered aluminium oxide. In addition to sodium and one or more rare gases, the filling of the discharge vessel may also comprise mercury. An operative condition of the lamp is to be understood hereinafter to mean the situation in which no discharge between the main electrodes takes place, and an operative condition of the lamp is to be understood hereinafter to mean the situation in which a stable arc discharge is maintained between the main electrodes.

A lamp of the indicated type is known from Netherlands Patent Application No. 7902634. The known lamp, which nowadays is widely used inter alia for public illumination purposes, is an efficient light source.

In the known lamp it is effected by means of the bimetal switch that the glow starter in the operative condition cannot become operative and hence cannot detrimentally influence the correct operation of the lamp. It is required that the contact point of the bimetal switch connected to the glow starter be suitably positioned during the life of the lamp with respect to the position of the bimetallic element of the bimetal switch, that is to say in such manner that in the inoperative condition of the lamp a good electric contact exists between the contact point and the bimetallic element and in the operative condition of the lamp no electric contact exists between the contact point and the bimetallic element. In the known lamp the right position of the contact point sometimes leaves much to be desired in practice.

It is the object of the invention to provide a means with which a right position of the contact point during the life of the lamp is ensured. For that purpose, the lamp of the kind mentioned in the opening paragraph is characterized according to the invention in that the contact point of the bimetal switch connected to the terminal of the glow starter is situated on the wall of the discharge vessel.

In the lamp according to the invention the position of the contact point is ensured. In addition the advantage is obtained that the construction for positioning the contact point is considerably simplified as compared with the known lamp.

In an advantageous embodiment of a lamp in accordance with the invention in which the glow starter is connected electrically to the first main electrode, the contact point connected to the terminal of the glow starter is present near the first main electrode, and, in the inoperative condition of the lamp, is connected electrically to the second main electrode. As an advantage of this embodiment it may be noted that even in the case in which the glow starter closes during the operative condition of the lamp, the occurrence of large potential differences across the wall of the discharge vessel is avoided. It is to be noted that the thermal energy evolved by the discharge may give rise to closing of the glow starter in the operative condition of the lamp. As a result of the bimetal switch present, by which in the operative condition of the lamp the electric contact between one of the main electrodes and the glow starter is interrupted, the discharge cannot be short-circuited by the glow starter by closing same in the case described. However, in this circumstance the contact point connected to the glow starter will assume the potential of the first main electrode as a result of which no large potential differences can occur across the wall of the discharge vessel in the proximity of the first main electrode and the contact point. Large potential differences across the wall of the discharge vessel are to be avoided because in practice it has been found that they give rise to migration of constituents of the filling of the discharge vessel through the wall of the vessel and hence to withdrawal of these constituents from the discharge. This may even result in extinction of the discharge.

In a lamp in accordance with the invention the discharge vessel advantageously comprises an external ignition electrode which, in the inoperative condition of the lamp, engages the discharge vessel for the greater part and which, in the inoperative condition, is removed for the greater part from the discharge vessel by means of the bimetal switch. In this manner, the bimetallic element of the bimetal switch is used both to electrically switch off the glow starter in the operative condition of the lamp and to remove the external ignition electrode from the wall of the discharge vessel.

An embodiment of a lamp according to the invention will be described in greater detail hereinafter with reference to a drawing, in which.

Figure 1:
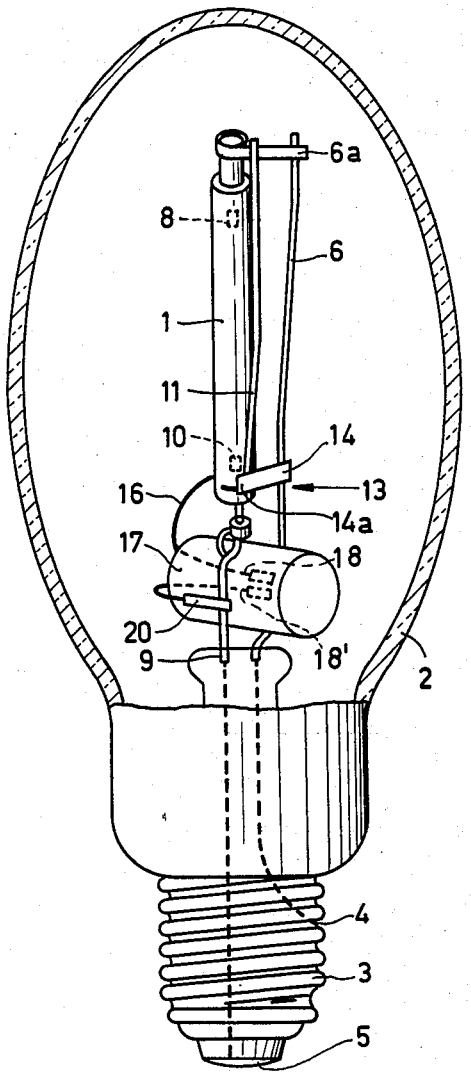
FIG. 1 shows a lamp according to the invention in the operative condition.

Reference numeral 1 in the lamp shown in FIG. 1 denotes a discharge vessel having a ceramic wall which is enveloped by an envelope 2 having a lamp cap 3. The lamp cap 3 has two connection points 4 and 5. Connection point 5 is connected to one end of a rigid current conductor 9. The other end of current conductor 9 leads to a first main electrode 10 of the discharge vessel 1. Connection point 4 is connected to one end of a rigid current conductor 6. The other end of current conductor 6 is connected to a current conductor **6*a* which leads to a second main electrode 8 of the discharge vessel 1. An external ignition electrode 11 is provided on the outside of the discharge vessel 1 and has one end conductively connected to current conductor 6*a***.

A bimetallic element 14 of bimetal switch 13 is connected to the current conductor 6 and has one end **14*a* connected to the external ignition electrode 11**.

Figure 3:
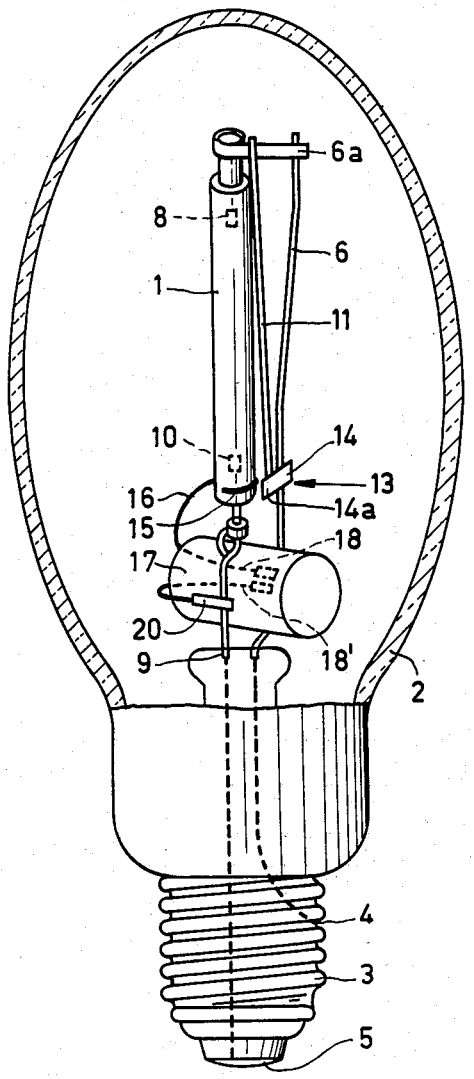
FIG. 3 shows the same lamp in the operative condition.
Figure 2:
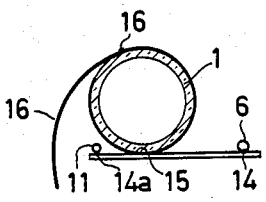
FIG. 2 is the plan view of a cross-section of the lamp shown in FIG. 1 in a plane through the first main electrode and the bimetal switch.

Terminal 18 of glow starter 17 is connected to a conductor 16 one end of which is wound around the discharge vessel 1 and engages the wall of the discharge vessel thus forming the contact point 15 of the bimetal switch 13. This is shown in FIGS. 2 and 3 in which parts corresponding to FIG. 1 are referred to by the same reference numerals. Another terminal 18' of glow starter 17 is connected to the current conductor 9 by means of conductor 20.

In the operative condition of the lamp the bimetallic element 14 engages the contact point 15 and the external ignition electrode 11 engages for the greater part the wall of the discharge vessel. In the operative condition of the lamp the bimetallic element 14 is removed from the discharge vessel, thus interrupting the contact with the contact point 15 and thus switching off electrically the glow starter 17. The external ignition electrode 11 is also removed for the greater part from the discharge vessel by the bimetallic element 14.

The operation of the lamp described will be explained hereinafter. When the lamp is connected to a voltage source via a stabilization ballast, a glow discharge will first be formed in the glow starter 17. As a result of this, thermal energy is evolved as a result of which the two contacts in the glow starter will close after some time. A current will then flow in the circuit 4, 6, 14, 15, 16, 18, 18', 20, 9, 5. The glow starter will now cool as a result of which its contacts will spread apart after some time. This switching off of the glow starter causes a voltage pulse of approximately 2000 volts, which is set up via contact point 15 and the bimetallic element 14 both between the main electrodes 8 and 10 and between the main electrode 10 and the auxiliary electrode 11. As a result of this an electric field is generated in the discharge vessel, as a result of which the discharge between the main electrodes 8 and 10 ignites. When this does not occur the first time, the procedure with the glow starter repeats itself.

In an embodiment of a lamp having a construction as shown in the drawing the filling of the discharge vessel consists of 15 mg of amalgam containing approximately 3 mg of sodium and approximately 12 mg of mercury, and xenon which at 300K has a pressure of $24\times10^3$ Pa (180 torr). The lamp is suitable for operation on a voltage source of 220 volts, 50 Hertz via a stabilization ballast (not shown) of approximately 0.7 H, thus dissipating a power of approximately 50 W. The length of the discharge vessel is approximately 45 mm, the spacing between the main electrodes is approximately 27 mm, while the external ignition electrode in the inoperative condition of the lamp bears against the wall of the discharge vessel over a length of approximately 30 mm.

In another embodiment of a lamp in accordance with the invention in which no external ignition electrode is present, the filling of the discharge vessel consists of approximately 15 mg of amalgam containing 3 mg of sodium and 12 mg of mercury, and xenon which at 300K has a pressure of $3.3\times10^3$ Pa (25 torr). The lamp is suitable for operation on a voltage source of 220 volts, 50 Hertz, via a stabilization ballast of 0.5 H, thus dissipating a power of approximately 70 W. The length of the discharge vessel is approximately 57 mm and the spacing between the main electrodes is approximately 35 mm.

What is claimed is:

1. A high-pressure sodium vapor discharge lamp comprising a discharge vessel having a ceramic wall, first and second main electrodes between which the discharge path extends, a bimetallic switch and a glow starter, said glow starter having a terminal which is connected to a contact point of said bimetallic switch, said glow starter, in the inoperative condition of the lamp, being connected electrically in parallel to said discharge path by means of said bimetallic switch and, in the operative condition of the lamp, being switched off electrically by means of said bimetallic switch, said contact point of said bimetallic switch connected to said terminal of said glow starter being disposed on said wall of said discharge vessel, said discharge vessel comprising an external ignition electrode which, in the inoperative condition of the lamp, engages said discharge vessel for the greater part and which, in the operative condition, is removed from said discharge vessel for the greater part by means of said bimetallic switch.

* * * * *